US006257039B1

(12) United States Patent
Childress

(10) Patent No.: US 6,257,039 B1
(45) Date of Patent: Jul. 10, 2001

(54) PAPER CLAMP PRESS

(76) Inventor: LuEllen Childress, 219 Justin, Shreveport, LA (US) 71105

( * ) Notice: Subject to any disclaimer, the term of this patent is extended or adjusted under 35 U.S.C. 154(b) by 0 days.

(21) Appl. No.: 09/374,482

(22) Filed: Aug. 13, 1999

Related U.S. Application Data

(60) Provisional application No. 60/096,717, filed on Aug. 17, 1998.

(51) Int. Cl.[7] ..... B21D 17/10

(52) U.S. Cl. ..... 72/211

(58) Field of Search ..... 72/211, 214, 220, 72/409.1, 409.2; 29/238, 268; 81/424.5, 424.6; 269/3, 6

(56) References Cited

U.S. PATENT DOCUMENTS

| | | | |
|---|---|---|---|
| 309,976 | 12/1884 | Oehler . | |
| 602,097 | 4/1898 | Oertle . | |
| 831,477 | 9/1906 | Sandall . | |
| 1,332,726 * | 3/1920 | Hobbs | 81/424.5 |
| 1,640,883 | 8/1927 | Coleman . | |
| 2,564,752 | 8/1951 | Collins | 81/3.5 |
| 4,023,450 | 5/1977 | Ygfors | 81/418 |
| 4,372,182 | 2/1983 | Kolter | 81/426 |

* cited by examiner

*Primary Examiner*—Rodney Butler
(74) *Attorney, Agent, or Firm*—John M. Harrison

(57) ABSTRACT

A paper clamp press for straightening or smoothing a bended, folded or creased clamp arm of a metal paper clamp. In a preferred embodiment the paper clamp press is characterized by a pair of pivoting, plier-type handles which terminate in top and bottom jaws which can be manipulated between open and closed positions by means of the handles. After the open jaws receive the distorted clamp arm, a cylindrical roller disposed for travel in the top jaw, presses the clamp arm against the bottom jaw along the length of the clamp arm, toward the extending end of the jaws as the jaws are pivoted to the closed position, progressively straightening or smoothing the clamp arm. A leaf spring provided in the top jaw returns the bidirectional roller to the pivoted end of the top jaw as the spring-biased handles are released and the jaws opened.

20 Claims, 2 Drawing Sheets

PAPER CLAMP PRESS

CROSS-REFERENCE TO RELATED APPLICATIONS

This application claims the benefit of copending U.S. Provisional Application Serial No. 60/096,717, filed Aug. 17, 1998.

BACKGROUND OF THE INVENTION

1. Field of the Invention

This invention relates to tools for shaping a workpiece and more particularly, to a paper clamp press for straightening or removing bends, folds or creases from a clamp arm of a metal file or paper clamp. In a preferred embodiment the paper clamp press is characterized by a pair of plier-type handles pivotally attached to each other and terminated by top and bottom jaws, respectively, which jaws are manipulable between open and closed positions by means of the handles. The bottom jaw of the open jaws first receives the distorted metal clamp arm of the paper clamp. A cylindrical roller spans interior roller channels provided in the sides of the top jaw for travel along the clamp arm toward the extending ends of the jaws as the jaws are pivoted from the open to the closed position, to press the clamp arm against the bottom jaw and progressively remove the bends and folds or creases from the clamp arm along its length. A leaf spring provided in the top jaw returns the bidirectional roller to the pivoted or handle end of the top jaw as the spring-biased handles are released and the jaws opened, after which the straightened clamp arm is removed from the bottom jaw.

A standard or conventional file or paper clamp is typically used to bind one or multiple sheets of paper in a page binder or file folder. A typical paper clamp includes a clamp strip which is attached to the inside spine of the page binder or file folder and a pair of metal clamp arms extend from respective ends of the clamp strip. The clamp arms are extended through respective openings provided in the page or pages and then a retainer strip is inserted on the clamp arms, after which the clamp arms are bent downward against the retainer strip and held in place by retainer rings provided on the retainer strip and slipped over the clamp arms, in order to secure the page or pages in the page binder. After repeated use of the clamp arms in removing and inserting pages in the page binder, with accumulation of multiple sheets secured in the folder by use of the clamp arms the clamp arms frequently become excessively bent and folded, making it difficult to remove and replace large stacks of pages and cumbersome to secure the clamp arms to the retainer strip when securing pages in the page binder. Accordingly, the paper clamp press of this invention provides a mechanism for straightening and smoothing one or both of the clamp arms of a paper clamp, making it easier to remove and replace the accumulated stack of pages or portions thereof, and to slide the clamp rings over the clamp arms while clamping pages in the page binder.

2. Description of the Prior Art

Various plier-type devices are known in the art for grasping and manipulating or shaping a workpiece. Typical of these devices is the "Watch Maker's Pliers" detailed in U.S. Pat. No. 309,976, dated Dec. 30, 1884, to Roman Oehler. The pliers are characterized by a pair of pivoting handles terminated by respective jaws for grasping and closing the joints of metal rings by use of the handles. An "Asparagus Holder" is detailed in U.S. Pat. No. 602,097, dated Apr. 12, 1898, to Chris H. Oertle. The asparagus holder is characterized by a pair of handles pivotally attached to each other and terminated by elongated jaws or holders to facilitate gripping and handling vegetables such as asparagus, by use of the handles. U.S. Pat. No. 831,477, dated Sep. 18, 1906, to Arthur Sandall, details a "Tool", characterized by a pair of pivoting handles terminated by jaws for gripping and shaping a wire. A pair of grooves provided in the tool register when the handles are apart and become offset when the handles are closed, such that a wire can be cut in the grooves as the handles are squeezed together. A "Hand Clamp" for repairing holes in shoes is described in U.S. Pat. No. 1,640,883, dated Aug. 30, 1927, to S. N. Coleman. The hand clamp is characterized by a pair of pivoting handles terminated by jaws, and opposing plates are provided in the respective jaws in facing relationship. One of the plates is placed inside the damaged shoe and the other plate outside the shoe over the hole in the shoe to be patched, and a patch spread with cement is inserted between the outside plate and the hole in the shoe. The jaws are closed using the handles, such that the patch is pressed and cemented against the shoe, thus sealing the hole. U.S. Pat. No. 2,564,752, dated Aug. 21, 1951, to John E. Collins, discloses "Optician's Pliers" for shaping temple bars on a pair of glasses. The optician's pliers are characterized by a pair of pivoted handles terminating in elongated top and bottom jaws, each having an L-shaped cross-sectional configuration. An arcuate anvil extends downwardly from the end of the bottom jaw. After the temple bar is heated to effect a desired pliability thereof, the temple bar is positioned between the jaws, which are then engaged with the temple bar to shape the temple bar over the anvil. U.S. Pat. No. 4,023,450, dated May 17, 1977, to Goran Ygfors, details "Pliers of Plastic" which are preferably reinforced with glass fibers and constructed from two lever members pivoted together to provide gripping jaws at one end and handles at the other end. The jaws are slightly elastic and have their meeting faces angled so that the faces diverge from the front of the jaws toward the pivot. Pressure exerted on the handles deflects the jaws until the jaw faces abut, and stops provided on the handle side of the pivot operate to limit and prevent jaw deflection movement beyond their full abutment disposition. A "Wire Wrap Removing Tool" is detailed in U.S. Pat. No. 4,372,182, dated Feb. 8, 1983, to Gary L. Kolter. The tool is characterized by a pair of pivoting handles terminated by jaws, each provided with an interior longitudinal groove toward the end thereof and is used to distort the configuration of a wrapped wire conductor on a terminal pin, thereby lessening the frictional contact between the wire conductor and the terminal pin to permit sliding of the wire conductor from the terminal pin.

An object of this invention is to provide a paper clamp press for straightening or smoothing a bended, folded or creased clamp arm of a metal paper clamp.

Another object of this invention is to provide a paper clamp press characterized by a pair of pivoting handles which terminate in top and bottom jaws, respectively, for receiving a bended, folded or creased clamp arm and a cylindrical roller disposed for travel in the top jaw for pressing the distorted clamp arm against the bottom jaw along the length of the clamp arm as the handles are used to pivot the jaws to the closed position, progressively removing bends and creases from the clamp arm.

Still another object of this invention is to provide a paper clamp press characterized by a pair of handles pivotally attached to each other and terminated by a top jaw and a bottom jaw, respectively, which bottom jaw receives a bended, creased or folded clamp arm of a metal paper clamp; a cylindrical roller having pins and disposed for travel in the top jaw from the pivot toward the extending end of the jaws for pressing the distorted clamp arm against the bottom jaw along the length of the clamp arm as the handles are used to pivot the jaws from an open to a closed position, to progressively straighten and remove the bends, folds or creases from the clamp arm; and a leaf spring provided in the top jaw for engaging and returning the bidirectional roller to the handle or pivoted end of the jaws as the spring-biased handles are released and the jaws opened, after which the straightened clamp arm is removed from the bottom jaw.

SUMMARY OF THE INVENTION

These and other objects of the invention are provided in a paper clamp press for straightening or smoothing a bended, folded or creased clamp arm of a metal paper clamp used to secure multiple pages in a page binder or file folder. In a preferred embodiment the paper clamp press is characterized by a pair of plier-type handles terminated by top and bottom jaws, respectively, and pivotally attached to each other between the handle grips and the jaws. The bottom jaw initially receives the distorted clamp arm, and a cylindrical roller which spans roller channels provided in the top jaw is disposed for travel from the pivoted ends to the extending ends of the jaws, along the clamp arm as the jaws are pivoted from the open to the closed position by operation of the handles. The traveling roller presses the clamp arm against the bottom jaw, progressively straightening and removing the bends, creases or folds from the clamp arm along its length. A leaf spring provided in the top jaw returns the bidirectional roller to the handle end of the jaws as the spring-biased handles are released and the jaws opened, and the straightened clamp arm is finally removed from the bottom jaw.

BRIEF DESCRIPTION OF THE DRAWINGS

The invention will be better understood by reference to the accompanying drawings, wherein.

DESCRIPTION OF THE PREFERRED EMBODIMENTS

Figure 1:
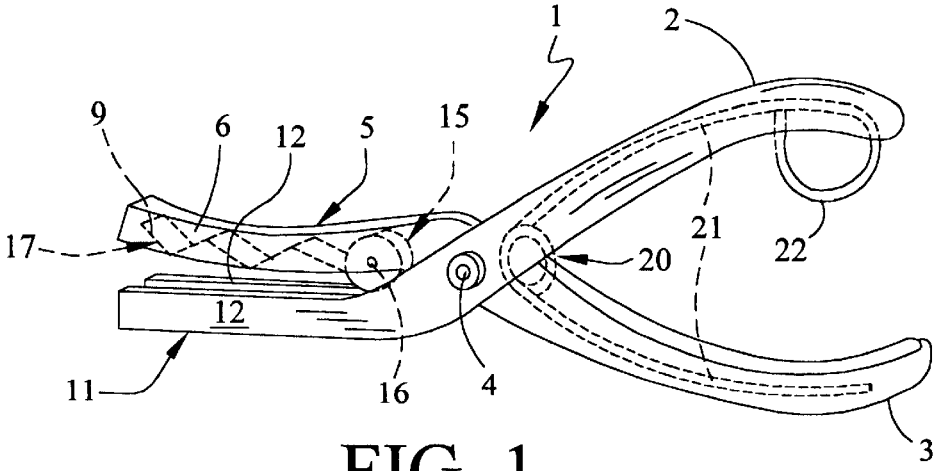
FIG. 1 is a side perspective view of a preferred embodiment of the paper clamp press of this invention.
Figure 2:
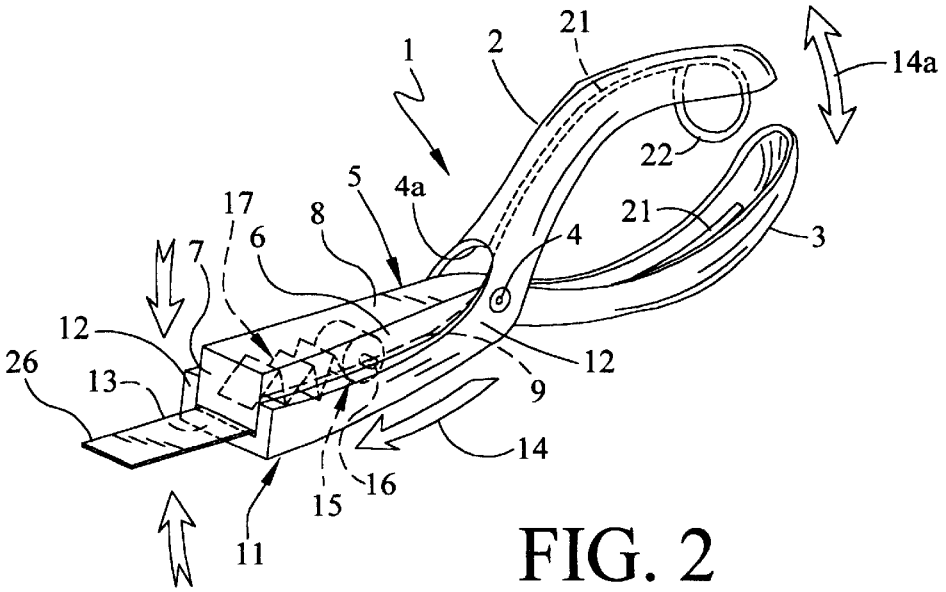
FIG. 2 is a front perspective view of the paper clamp press illustrated in FIG. 1, with a clamp arm inserted for straightening in the bottom jaw of the paper clamp.
Figure 3:
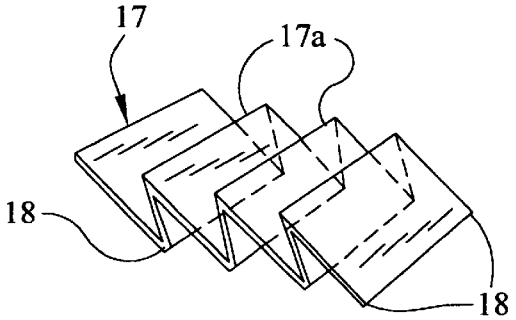
FIG. 3 is a perspective view of a leaf spring element of the paper clamp press for biasing the roller element in the top jaw toward the handle end of the jaws.
Figure 4:
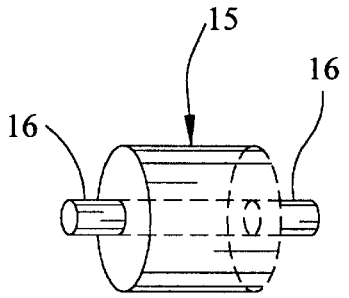
FIG. 4 is a perspective view of a roller element of the paper clamp press.
Figure 5:
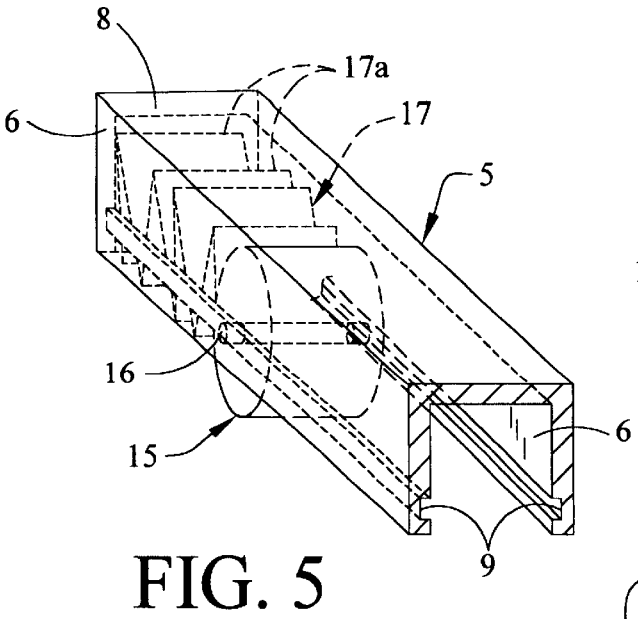
FIG. 5 is a perspective view of the top jaw element of the paper clamp press, with the roller (in phantom) biased toward the handle end of the jaws, by means of the leaf spring illustrated in FIG. 3 (also in phantom)
Figure 6:
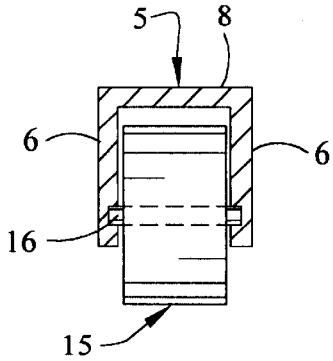
FIG. 6 is a rear view of the top jaw illustrated in FIG. 5, with the roller disposed for bidirectional travel in the top jaw.

Referring initially to FIGS. 1–6 of the drawings, in a preferred embodiment the paper clamp press of this invention is generally illustrated by reference numeral 1. The paper clamp press 1 includes a top handle 2, terminated by a bottom jaw 11 having a pair of spaced-apart bottom jaw side walls 12 extending perpendicularly from a bottom wall 13, as illustrated in FIG. 2. A bottom handle 3 is terminated by a top jaw 5 having a slightly concave top wall 8 and parallel top jaw side walls 6, as illustrated in FIG. 6, as well as a top jaw front wall 7, as further illustrated in FIG. 2. The top jaw 5 extends from the bottom handle 3 through a pivot opening **4*a* provided in the top handle 2, and is connected to the bottom jaw side walls 12 of the bottom jaw 11 adjacent to the top handle 2, by means of a pivot pin 4. A pair of spring arms 21 of a coil spring 20 (FIG. 1), typically shaped with a spring loop 22, bias the top handle 2 and bottom handle 3 away from each other in conventional fashion, as illustrated by the arrow 14*a* in FIG. 2, and the top jaw 5 and bottom jaw 11 in the open configuration illustrated in FIG. 1. When the top jaw 5 and bottom jaw 11 are pivoted to the fully-closed position by operation of the top handle 2 and bottom handle 3 and against the bias exerted by the coil spring 20, the top jaw 5 fits between the parallel bottom jaw side walls 12 of the bottom jaw 11, as illustrated in FIG. 2. As further illustrated in FIG. 5, roller channels 9 are shaped in the inside surfaces of the respective top jaw side walls 6 of the top jaw 5 and roller pins 16 of a cylindrical roller 15, illustrated in FIG. 4, are seated in the respective roller channels 9 to facilitate bidirectional travel of the roller 15 in the top jaw 5 and against the bottom wall 13 of the bottom jaw 11, as hereinafter further described. As illustrated in FIGS. 1, 3 and 5, a leaf spring 17, characterized by multiple folds 17*a* and constructed from brass or other flexible metal, is interposed between the top jaw front wall 7 and roller 15 in the top jaw 5, and includes spring bearings 18 at the respective comers thereof which are slidably disposed in the roller channels 9. The leaf spring 17 normally biases the roller 15 in the top jaw 5 toward the pivot pin 4, as illustrated in FIG. 1**.

Figure 8:
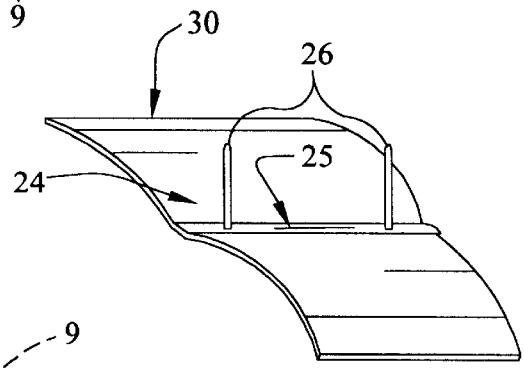
FIG. 8 is a perspective view of a page binder or file folder, including a standard or conventional paper clamp with clamp arms.
Figure 7:
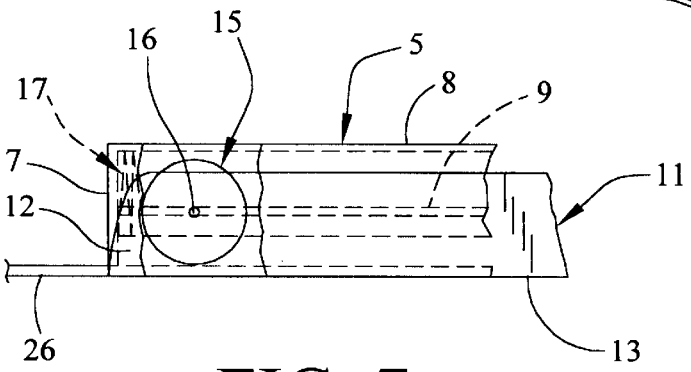
FIG. 7 is a side view, partially in section, of the top and bottom jaws of the paper clamp press, pivoted to the fully-closed position in straightening the inserted clamp arm.
Figure 9:
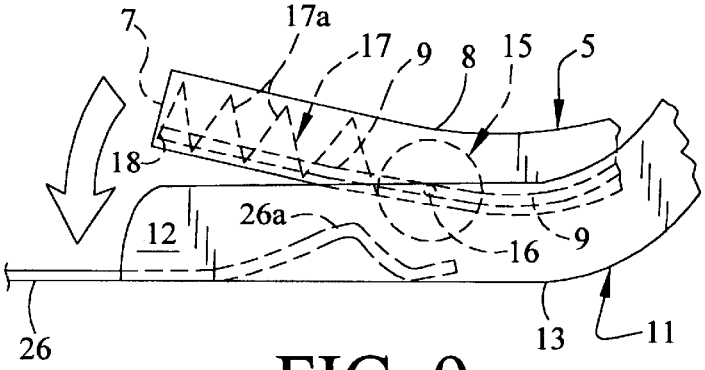
FIG. 9 is a side view, partially in section, of the paper clamp press of this invention, more particularly illustrating straightening of a distorted clamp arm inserted in the bottom jaw, by pivoting the jaws of the paper clamp press from the open to the closed position by operation of the handles.

Referring again to FIG. 2 and to FIGS. 7–9 of the drawings, in operation of the paper clamp press 1, the bended, folded or creased clamp arm 26 of a metal paper clamp 24, typically characterized by a clamp strip 25 normally attached to the spine of a page binder 30 as illustrated in FIG. 8, is inserted in the bottom jaw 11 of the paper clamp press 1 between the bottom jaw side walls 12, such that the clamp arm 26 rests on the bottom wall 13 of the bottom jaw 11, as illustrated in FIG. 9. As the top handle 2 and bottom handle 3 are squeezed together against the bias exerted by the spring arms 21 of the coil spring 20, the top jaw 5 and bottom jaw 11 are pivoted toward one another on the pivot pin 4, causing the roller 15 to roll on the bottom wall 13 of the bottom jaw 11 with the roller pins 16 in the roller channels 9, in the direction indicated by the arrow 14 in FIG. 2, against bias exerted by the leaf spring 17. Simultaneously, the clamp arm 26 is pressed between the roller 15 and the bottom wall 13 of the bottom jaw 11, as illustrated in FIGS. 7 and 9, such that bends **26*a* are removed from the clamp arm 26 throughout the length of that portion of the clamp arm 26 contained in the bottom jaw 11. After the top jaw 5 and bottom jaw 11 reach the fully-closed position illustrated in FIG. 7 and the leaf spring 17 is compressed between the roller 15 and the front wall 7 of the top jaw 5, the top handle 2 and bottom handle 3 are released. The spring arms 21 of the coil spring 20 pivot the top jaw 5 and bottom jaw 11 to the open position, the compressed leaf spring 17 pushes the roller 15 to the position illustrated in FIG. 1 and the straightened clamp arm 26 is removed from the bottom jaw 11**.

While the preferred embodiments of the invention have been described above, it will be recognized and understood that various modifications may be made in the invention and the appended claims are intended to cover all such modifications which may fall within the spirit and scope of the invention.

What is claimed is:

1. A paper clamp press for pressing and removing bends from a metal clamp arm of a paper clamp, said paper clamp press comprising an elongated bottom jaw for receiving the clamp arm and an elongated top jaw pivotally carried by said bottom jaw at one end of said bottom jaw and said top jaw; a top handle extending from said one end of said bottom jaw and a bottom handle extending from said one end of said top jaw for manipulating said top jaw and said bottom jaw between open and closed positions; a pair of roller channels shaped in said top jaw and a cylindrical roller spanning said roller channels for pressing the clamp arm against said bottom jaw, said roller disposed for travel from said one end of said bottom jaw to the other end of said bottom jaw along the clamp arm as said top jaw is pivoted from said open position to said closed position; and a leaf spring provided in said top jaw for biasing said roller toward said one end of said top jaw, whereby bends are progressively removed from the clamp arm as said roller traverses the length of the clamp arm against the bias of said leaf spring responsive to manipulation of said top handle and said bottom handle together.

2. A paper clamp press for pressing and removing bends from a clamp arm of a paper clamp, said paper clamp press comprising a bottom jaw for receiving the clamp arm and a top jaw pivotally carried by one end of said bottom jaw and roller means disposed in said top jaw for traversing said top jaw and pressing the clamp arm against said bottom jaw, said roller means disposed for travel from said one end of said bottom jaw to the other end of said bottom jaw along the clamp arm as said top jaw and said bottom jaw are pivoted from an open position to a closed position, whereby bends are progressively removed from the clamp arm as said roller means traverses the length of the clamp arm.

3. The paper clamp press of claim 2 comprising a leaf spring provided in said top jaw for biasing said roller means against travel along the clamp arm as said top jaw and said bottom jaw are pivoted to said closed position.

4. The paper clamp press of claim 2 comprising handle means carried by said top jaw and said bottom jaw for manipulating said top jaw and said bottom jaw between said open and closed positions.

5. The paper clamp press of claim 2 comprising a leaf spring provided in said top jaw for biasing said roller means against travel along the clamp arm as said top jaw and said bottom jaw are pivoted to said closed position, and handle means carried by said top jaw and said bottom jaw for manipulating said top jaw and said bottom jaw between said open and closed positions.

6. The paper clamp press of claim 2 comprising roller channels shaped in said top jaw and wherein said roller means spans said roller channels.

7. The paper clamp press of claim 6 comprising handle means carried by said top jaw and said bottom jaw for manipulating said top jaw and said bottom jaw between said open and closed positions.

8. The paper clamp press of claim 7 comprising a leaf spring provided in said top jaw for biasing said roller means against travel along the clamp arm as said top jaw and said bottom jaw are pivoted to said closed position.

9. A paper clamp press for pressing a clamp arm of a paper clamp, said paper clamp press comprising jaw means for receiving the clamp arm and manipulable to open and closed positions and roller means provided in said jaw means for pressing the clamp arm against said jaw means, said roller means disposed for travel along the clamp arm as said jaw means is manipulated from said open position to said closed position.

10. The paper clamp press of claim 9 comprising bias means provided in said jaw means for biasing said roller means against travel along the clamp arm as said jaw means is pivoted to said closed position.

11. The paper clamp press of claim 9 comprising handle means carried by said jaw means for manipulating said jaw means between said open and closed positions.

12. The paper clamp press of claim 9 comprising bias means provided in said jaw means for biasing said roller means against travel along the clamp arm as said jaw means is pivoted to said closed position, and handle means carried by said jaw means for manipulating said jaw means between said open and closed positions.

13. The paper clamp press of claim 9 comprising roller channels shaped in said jaw means and wherein said roller means spans said roller channels.

14. The paper clamp press of claim 10 wherein said bias means comprises a leaf spring.

15. The paper clamp press of claim 13 comprising bias means provided in said jaw means for biasing said roller means against travel along the clamp arm as said jaw means is pivoted to said closed position.

16. The paper clamp press of claim 13 comprising handle means carried by said jaw means for manipulating said jaw means between said open and closed positions.

17. The paper clamp press of claim 13 comprising bias means provided in said jaw means for biasing said roller means against travel along the clamp arm as said jaw means is pivoted to said closed position, and handle means carried by said jaw means for manipulating said jaw means between said open and closed positions.

18. The paper clamp press of claim 14 comprising handle means carried by said jaw means for manipulating said jaw means between said open and closed positions.

19. The paper clamp press of claim 14 comprising roller channels shaped in said jaw means and wherein said roller means spans said roller channels.

20. The paper clamp press of claim 14 comprising handle means carried by said jaw means for manipulating said jaw means between said open and closed positions and roller channels shaped in said jaw means and wherein said roller means spans said roller channels.

* * * * *